US007918411B2

(12) United States Patent
Anderson et al.

(10) Patent No.: US 7,918,411 B2
(45) Date of Patent: Apr. 5, 2011

(54) FOOD WASTE DISPOSER WITH DISHWASHER INLET AND METHOD OF MAKING SAME

(75) Inventors: Scott W. Anderson, Racine, WI (US); Christian Georgeff, Wauwatosa, WI (US); Randall E. Hammer, Muskego, WI (US)

(73) Assignee: Emerson Electric Co., St. Louis, MO (US)

( * ) Notice: Subject to any disclaimer, the term of this patent is extended or adjusted under 35 U.S.C. 154(b) by 194 days.

(21) Appl. No.: 12/131,163

(22) Filed: Jun. 2, 2008

(65) Prior Publication Data

US 2008/0302891 A1 Dec. 11, 2008

Related U.S. Application Data

(60) Provisional application No. 60/934,025, filed on Jun. 8, 2007.

(51) Int. Cl.
*B02C 19/00* (2006.01)

(52) U.S. Cl. ..... 241/46.016; 241/46.012

(58) Field of Classification Search . 241/46.012–46.016
See application file for complete search history.

(56) References Cited

U.S. PATENT DOCUMENTS 3,695,519 A 10/1972 Bebinger
4,135,258 A * 1/1979 Braga et al. ..... 241/46.015
5,249,749 A 10/1993 Krebsbach
7,331,539 B2 2/2008 Jara-Almonte et al.
2004/0256506 A1 12/2004 Berger

FOREIGN PATENT DOCUMENTS

JP 2006-239606 9/2006

OTHER PUBLICATIONS

International Search Report for PCT/US2008/006952 dated Dec. 18, 2008.
Chinese Office Action issued Dec. 1, 2010.

* cited by examiner

*Primary Examiner* — Mark Rosenbaum
(74) *Attorney, Agent, or Firm* — Harness, Dickey & Pierce, P.L.C.

(57) ABSTRACT

A food waste disposer has a food conveying section, a motor section and a central grinding section disposed between the food conveying section. The motor section includes a motor having a motor shaft coupled to a rotatable plate of a grinding mechanism in the grinding section. An anti-vibration mount is disposed around an inlet of the food conveying section. The food conveying section includes a housing, which can be a plastic molded housing, having dishwasher inlet having an outer portion extending outwardly from the housing and an inner portion extending into the housing that is removably received in the housing. The inner portion of the dishwasher inlet may be slidably received in the housing with the housing including grooves on opposed sides of an opening that receive tongues on opposed sides of a body of the inner portion of the dishwasher inlet. The inner and outer portions of the dishwasher inlet have passageways connected by the opening in the housing when the inner portion of the dishwasher inlet is in place.

10 Claims, 5 Drawing Sheets

FOOD WASTE DISPOSER WITH DISHWASHER INLET AND METHOD OF MAKING SAME

CROSS-REFERENCE TO RELATED APPLICATIONS

This application claims the benefit of U.S. Provisional Application No. 60/934,025 for "Dishwasher Inlet" filed Jun. 8, 2007. The disclosure of the above application is incorporated herein by reference.

FIELD

The present disclosure relates to food waste disposers.

BACKGROUND

The statements in this section merely provide background information related to the present disclosure and may not constitute prior art.

Food waste disposers are known in the art, such as the food waste disposers disclosed in U.S. Pat. No. 6,007,006 for a "Food Waste Disposer" and 6,439,487 for "Grinding Mechanism for a Food Waste Disposer and Method of Making the Grinding Mechanism," the entire disclosures of which are incorporated herein by reference.

FIG. 1 depicts a vertical cross-section of a typical food waste disposer 100. The disposer may be mounted in a well-known manner in the drain opening of a sink using mounting members of the type disclosed in U.S. Pat. No. 3,025,007, which is owned by the assignee of the present application, and incorporated herein by reference in its entirety. The disposer includes an upper food conveying section 112, a lower motor section 114, and a central grinding section 116 disposed between the food conveying section 112 and the motor section 114. The food conveying section 112 includes an injection-molded plastic housing 118 that forms an inlet 120 at its upper end for receiving food waste and water. The housing 118 also forms a dishwasher inlet 121 for passing water discharged from a dishwasher (not shown). As used herein, a "dishwasher inlet" is a member such as a fitting to which an outlet of a dishwasher can be coupled such as by hose, and provides a fluid passageway into the food waste disposer through which waster discharged from the dishwasher can flow into the food waste disposer. The food conveying section 112 conveys the food waste to the central grinding section 116. The motor section 114 includes an induction motor 122 imparting rotational movement to a motor shaft 124. The motor 122 is enclosed within a motor housing 126 having a stamped metal upper end frame 128, a stamped metal lower end frame 130, and a bent metal stator band 132 extending between the upper and lower end frames 128 and 130.

The grinding section 116 includes a grinding mechanism having a circular grinding plate or disc 134, a pair of lugs 136, and a stationary shredder ring 138. The plate 134 is mounted to the motor shaft 124 of the motor section 114 and rotates with motor shaft 124. The lugs 136 are fastened to the plate 134 but are free to rotate relative to the plate 134. The grinding section 116 includes an injection-molded plastic housing 140 integrally formed with the injection-molded upper housing 118 of the food conveying section 112. The integrated injection-molded plastic housings 118 and 140 form a unitary plastic enclosure. The enclosure is fastened to the lower end frame 130 by a plurality of bolts 141 having self-tapping threads.

To prevent the food waste from leaking between the housing 140 and the upper end frame 128, a sealant bead 143 is applied therebetween. The sealant bead 143 is preferably composed of a tacky, malleable material that fills any voids between the housing 140 and the upper end frame 128 and tempers any irregularities in the opposing surfaces of the housing 140 and the upper end frame 128. Some suitable malleable materials for the sealant bead 143 include butyl sealant, silicone sealant, and epoxy.

The housing 140 of the grinding section 116 encompasses the grinding mechanism. The shredder ring 138, which includes a plurality of spaced teeth 142, is fixedly attached to an inner surface of the housing 140 by an interference fit and is preferably composed of galvanized steel. Since the housing 140 is composed of injection-molded plastic instead of die-cast metal, the housing 140 is resistant to corrosion from the shredder ring 138. In the operation of the food waste disposer, the food waste delivered by the food conveying section 112 to the grinding section 116 is forced by the lugs 136 on the plate 134 against the teeth 142 of the shredder ring 138. The sharp edges of the teeth 142 grind or comminute the food waste into particulate matter sufficiently small to pass from above the plate 134 to below the plate 134 via gaps between the teeth 142 outside the periphery of the plate 134. Due to gravity, the particulate matter that passes through the gaps between the teeth 142 drops onto the upper end frame 128 and, along with water injected into the disposer 100 via the inlet 120, is discharged through a discharge outlet 144 into a tailpipe 146. To direct the mixture of particulate matter and water toward the discharge outlet 144, the upper end frame 128 is sloped downward toward its periphery.

The discharge outlet 144 is formed by the plastic housing 140 and has a threaded outer surface. The threaded outer surface of the discharge outlet 144 allows the tailpipe 146 to be connected to the discharge outlet 144 using an off-the-shelf plumbing nut 148.

The stamped metal upper end frame 128 separates the grinding section 116 from the motor 122. To promote concentricity of the motor shaft 124 relative to the stator band 132 and of the plate 134 relative to the shredder ring 138, a peripheral lip of the upper end frame 128 is secured between the plastic housing 140 and the stator band 132. The upper end frame 128 dissipates the heat generated by the motor 122, prevents particulate matter and water from contacting the motor 122, and directs the mixture of particulate matter and water to the discharge outlet 144.

To align the motor shaft 124 relative to the stator band 132 and, at the same time, permit rotation of the motor shaft 124 relative to the upper end frame 128, the upper end frame 128 forms a central bearing pocket 150 supporting a powdered metal spherical bearing 152. The spherical bearing 152 encompasses the motor shaft 124 and is retained in the bearing pocket 150 by a steel bearing retainer 154. To evenly distribute downward loads created by the grinding mechanism onto the bearing 152, a thrust washer 156 encompasses the motor shaft 124 and is positioned immediately above the spherical bearing 152. A steel sleeve 158 encompasses the motor shaft 124, is positioned immediately above the thrust washer 156, and is surrounded by a spring-loaded rubber seal 160. Finally, the steel sleeve 158 is covered by a steel cap 162 for keeping out debris.

The injection-molded plastic housings 118 and 140 are composed of a plastic material that exhibits impact resistance, heat resistance, and corrosion resistance. Some suitable plastic materials for the housings include acrylonitrile butadiene styrene (ABS), polyvinyl chloride (PVC), polyester, and polyphenylene sulfide. The housings 118 and 140 preferably have a wall thickness ranging from about 0.120 inch to about 0.160 inch. In a preferred embodiment, the housings 118 and 140 have a wall thickness of about 0.140 inch. To enhance the structural rigidity of the housing 140, the housing 140 may be provided with a plurality of stiffening ribs (not shown).

The upper end frame 128 is preferably composed of stamped metal that is capable of conducting the heat generated by the motor 122 to the water flowing through the disposer and is sufficiently rigid to withstand downward loading forces applied by the plate 134 of the grinding mechanism. Some suitable metals include double-sided galvanized cold-rolled steel, cold-rolled steel, stainless steel, and other types of steel. Alternatively, the upper end frame 128 may be composed of a structurally rigid plastic material capable of dissipating the heat generated by the motor 122. When composed of stamped metal, the upper end frame 128 preferably has a wall thickness ranging from about 0.040 inch to about 0.060 thick. In a preferred embodiment, the upper end frame 128 is composed of double-sided galvanized cold-rolled steel and has a wall thickness of about 0.047 inch.

Dishwasher inlet 121 is extended laterally into grind chamber 164 of the disposer body in order to pass certain agency tests included in ASSE 1008. The grind chamber 164 is defined by housings 118 and 140. The approving agencies, such as ASSE and UL, require a disposer to pass, among others, a pumping test prior to the disposer being marketed. The pumping test can typically be passed if the dishwasher inlet extends into the grind chamber.

In a disposer having the prior art dishwasher inlet 121, the dishwasher inlet including the portion that extends into the grind chamber 164 is molded integrally as part of housing 118. This dishwasher inlet structure causes difficulty in the molding of an anti-vibration mount which food waste disposers often have. The anti-vibration mount is an annular mount molded of a resilient material around inlet 120 of housing 118. Examples of such anti-vibration mounts are disclosed in U.S. Pat. No. 7,021,574 issued Apr. 4, 2006 for "Overmolded Vibration Isolation Gasket for Mounting Food Waste Disposer to Sink," the entire disclosure of which is incorporated herein by reference.

In some cases, the molding of the anti-vibration mount is performed from inside the grind chamber. The presence of the portion of the dishwasher inlet in the grind chamber prevents the molding tool from reaching certain portions of the anti-vibration mount, thereby increasing molding complexity of the anti-vibration mount. Moreover, the presence of the dishwasher inlet inside the grind chamber also causes difficulty in the molding of the disposer body.

SUMMARY

A food waste disposer has a food conveying section, a motor section and a central grinding section disposed between the food conveying section. The motor section includes a motor having a motor shaft coupled to a rotatable plate of a grinding mechanism in the grinding section. An anti-vibration mount is disposed around an inlet of the food conveying section. The food conveying section includes a plastic molded housing having a dishwasher inlet having an outer portion extending outwardly from the housing and an inner portion extending into the housing that is removably received in the housing.

In an aspect, the inner portion of the dishwasher inlet is slidably received on an inner wall of the housing with the inner wall of the housing including grooves on opposed sides of an opening that receive tongues on opposed sides of a body of the inner portion of the dishwasher inlet. The inner and outer portions of the dishwasher inlet have passageways connected by the opening in the housing when the inner portion of the dishwasher inlet is in place.

In an aspect, the inner wall of the housing has the tongues and the body of the inner portion of the dishwasher inlet has the grooves.

In an aspect, an anti-vibration mount is molded around an inlet of the housing and after the anti-vibration mount is molded, the inner portion of the dishwasher inlet is inserted into the housing and secured in place.

In an aspect, a stationary grind ring holds the inner portion of the dishwasher inlet in place.

In an aspect, the tongues and grooves have an interference fit to hold the inner portion of the dishwasher inlet in place.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
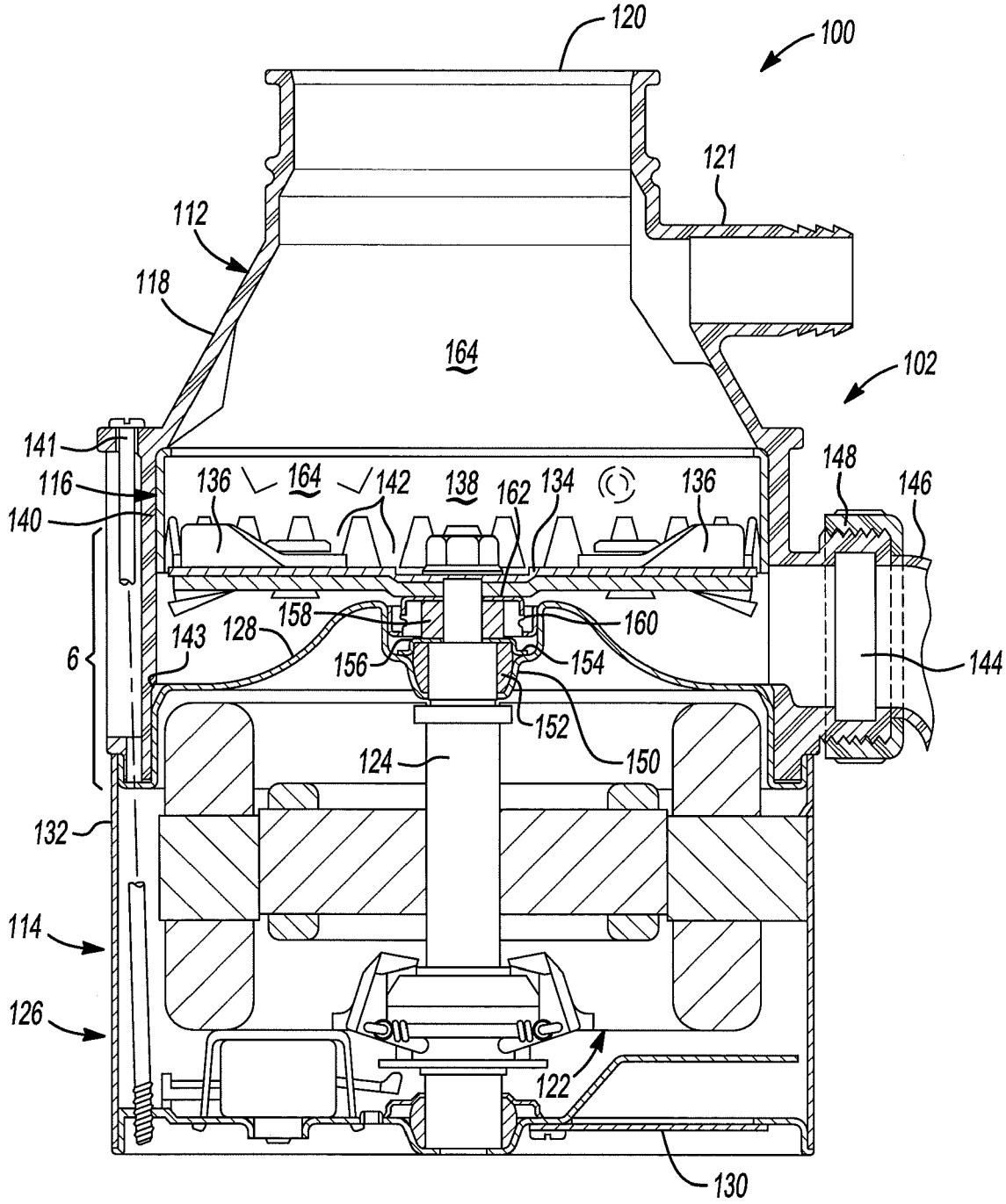
Fig-1 PRIOR ART
FIG. 1 is a cross-section of a typical prior art food waste disposer.

The following description is merely exemplary in nature and is not intended to limit the present disclosure, application, or uses. It should be understood that throughout the drawings, corresponding reference numerals indicate like or corresponding parts and features.

Figure 2:
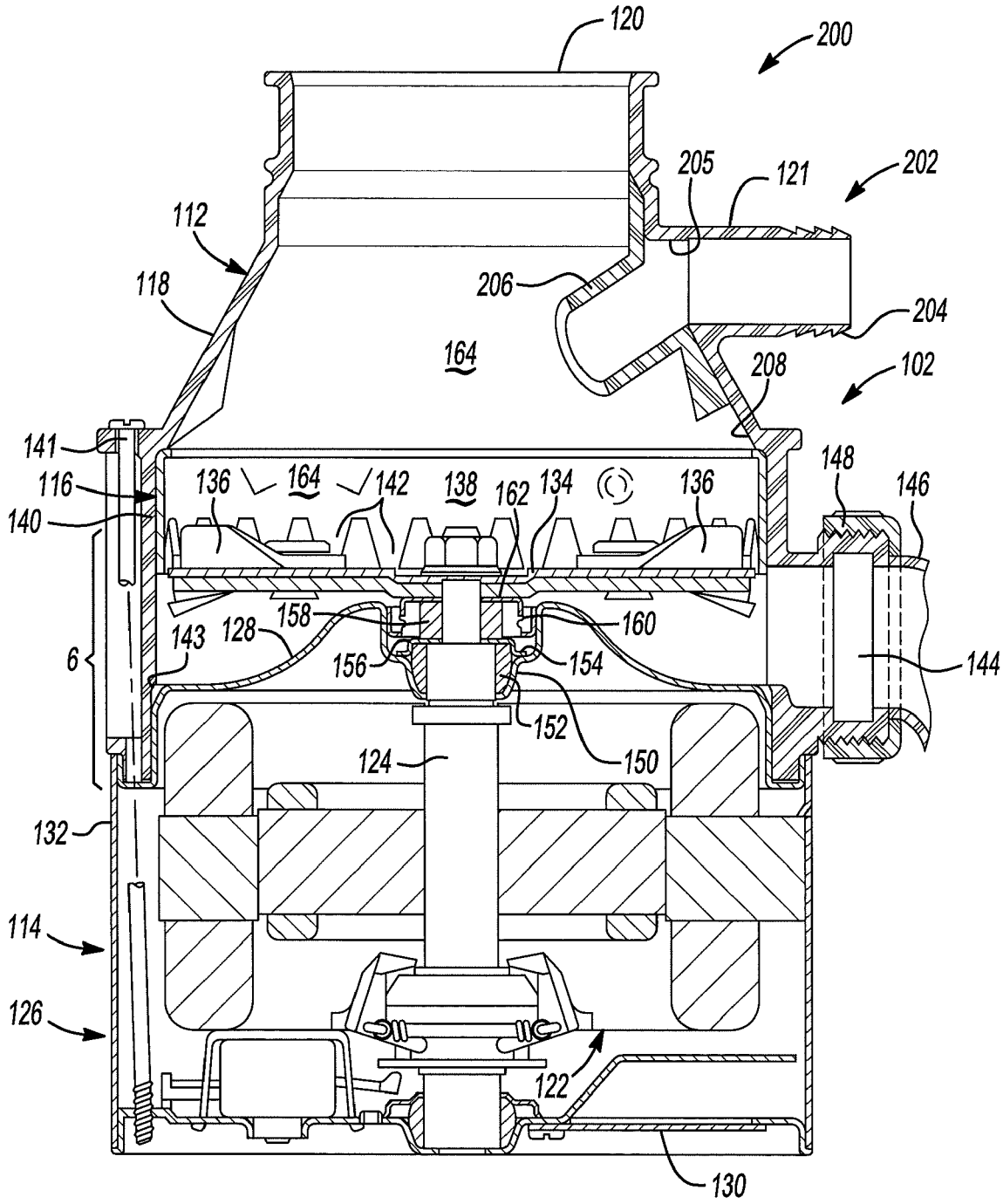
FIG. 2 is a cross-section of a food waste disposer having a dishwasher inlet in accordance with an aspect of the present disclosure.
Figure 3:
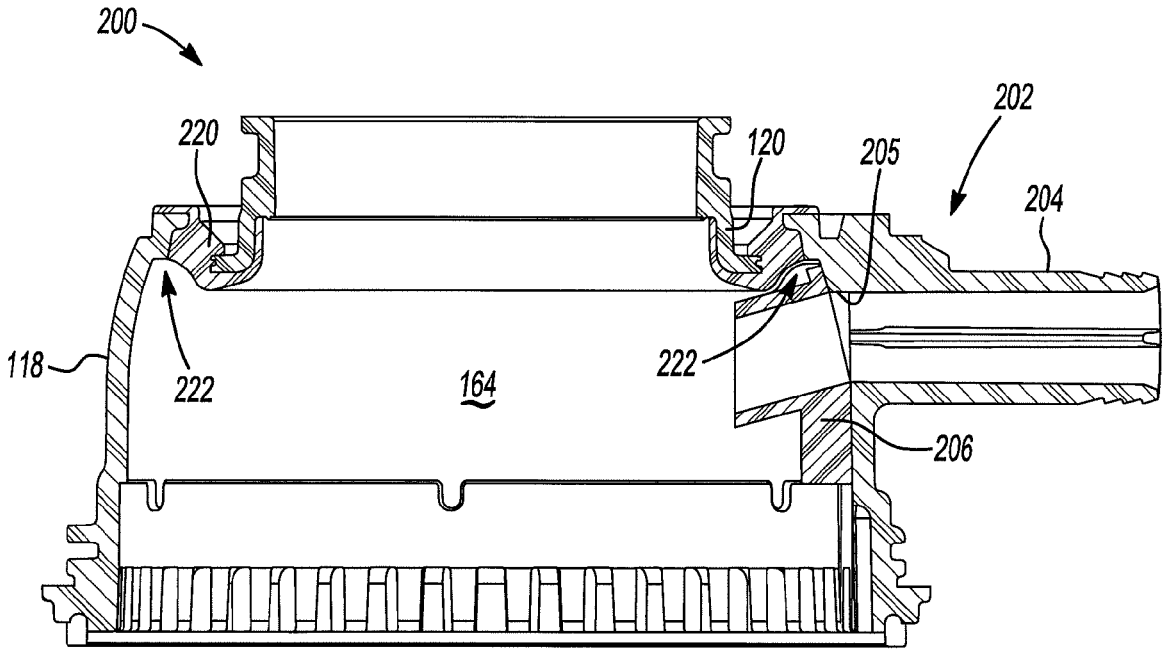
FIG. 3 is a partial cross-section of the food waste disposer of FIG. 2.

With reference to FIG. 2, a food waste disposer 200 having a dishwasher inlet 202 in accordance with an aspect of the present disclosure is described. Dishwasher inlet 202 includes outer and inner portions 204, 206 each having passageways therein that are connected by an opening 205 in housing 118. Outer portion 204 may illustratively include a tubular fitting projecting outwardly from housing 118 to which a hose (not shown) from a dishwasher outlet is coupled. Inner portion 206 may illustratively include a tubular portion projecting inwardly into grind chamber 164 from opening 205 (FIG. 3).

Outer and inner portions 204, 206 are separate parts, and inner portion 206 is separate part from housing 118. Outer portion 204 may illustratively be integrally molded with housing 118 when housing 118 is molded, or separately affixed to housing 118. Inner portion 206 may illustratively be a molded plastic part. Inner portion 206 may illustratively be a slide-in component, as described below.

Figure 4:
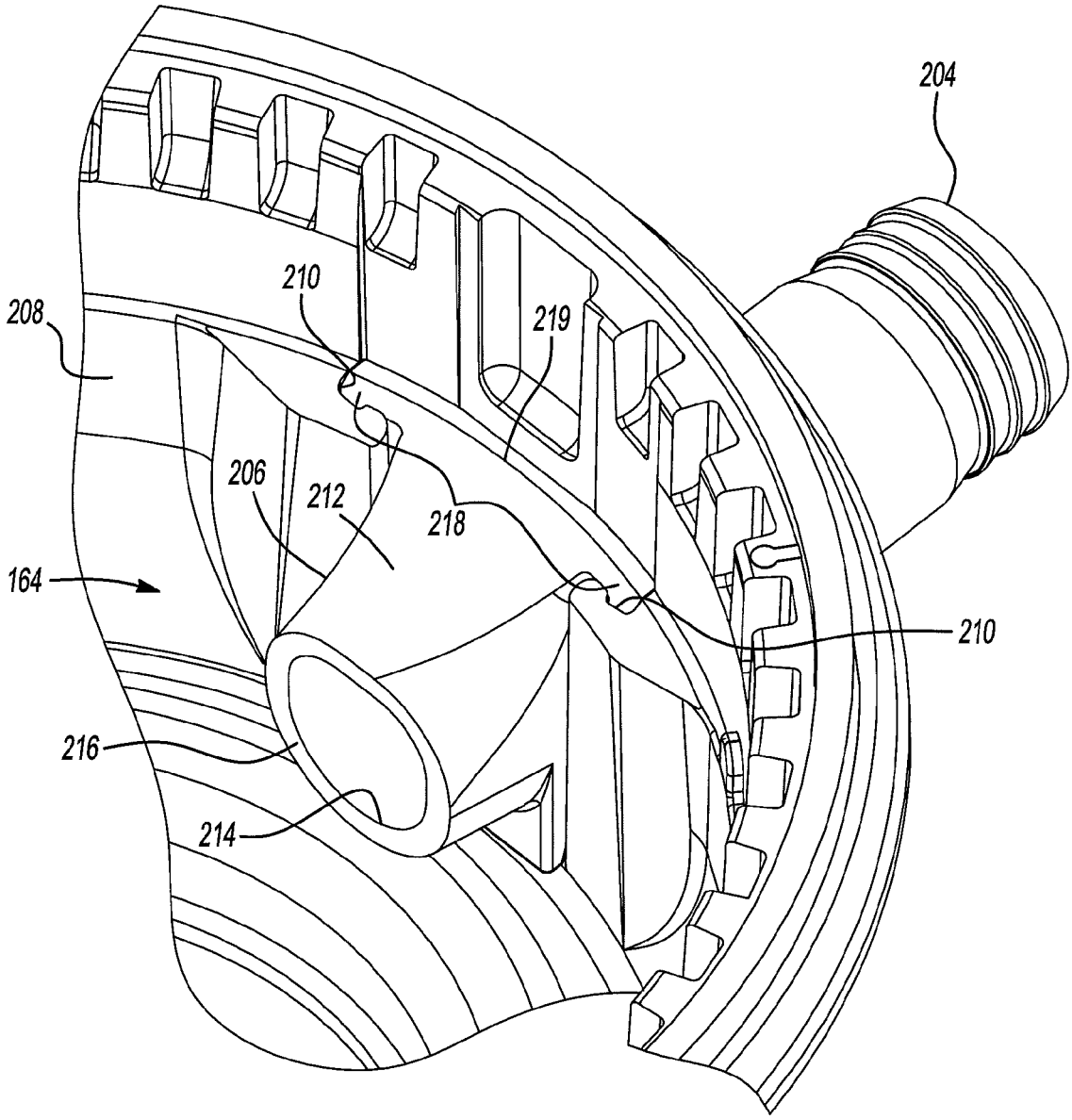
FIG. 4 is a perspective view showing an inner portion of the dishwasher inlet of the disposer of FIG. 2 received on an inner surface of a housing of the food waste disposer of FIG. 2.

As best shown in FIG. 4, inner wall 208 of housing 118 includes one or more features adjacent opening 205 in housing 118 that engage with corresponding features of inner portion 206 of dishwasher inlet 202, as described below.

These features of housing 118 are illustratively opposed grooves 210 on opposite sides of opening 205 in housing 118, which may illustratively be formed when housing 118 is molded. Inner portion 206 of dishwasher inlet 202 includes a generally tubular body 212 having an outlet 214 at an inner end 216 and features, illustratively opposed tongues 218, that extend from opposed sides of body 212 at an outer end 219 thereof, that engage with the features of the inner wall 208 of housing 118.

After housing 118, and anti-vibration mount 220 which is molded around inlet 120 of housing 118, have been formed, inner portion 206 is inserted into housing 118 and affixed in place. Illustratively, the tongues 218 of inner portion 206 are inserted and slid into the grooves 210 of the housing 118 of disposer 200 to mount the inner portion 206 of dishwasher inlet 202 to housing 118 inside grind chamber 164.

Figure 5:
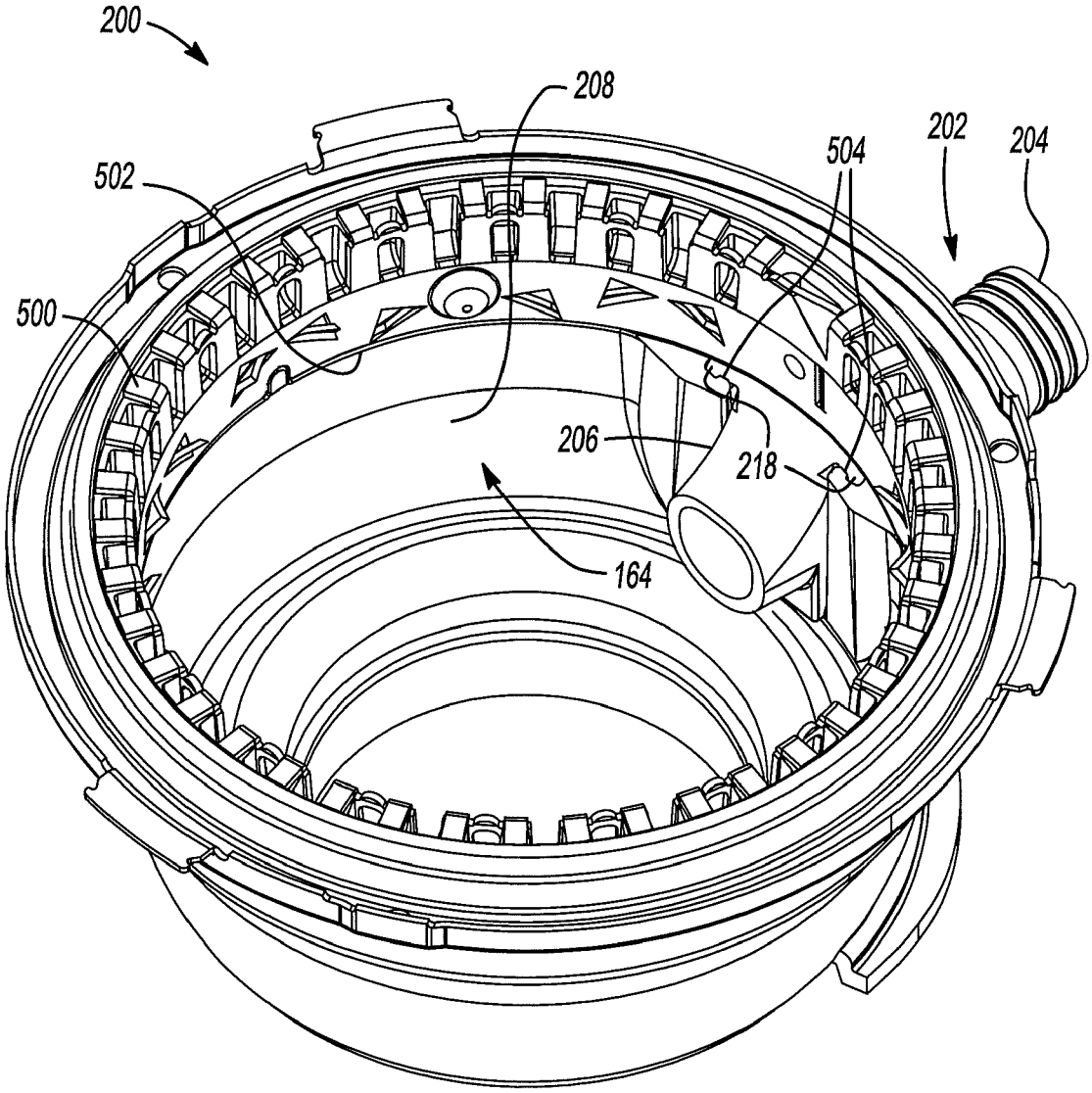
FIG. 5 is a perspective view showing an inner portion of the food waste disposer of FIG. 2.

With reference to FIG. 5, when a stationary grind ring 500 is mounted to the inner wall 208 of the housing 118, an upper end 502 (when the food waste disposer 200 is upright) of the stationary grind ring 500 abuts against lower ends 504 of the tongues 218 of inner portion 206 of dishwasher inlet 202, thereby retaining the inner portion 206 of the dishwasher inlet 202 in place. The tongues 218 of the inner portion 206 can easily fall out of the grooves 210 of the housing 118 body when the stationary grind ring 500 is removed. This tongue-and-groove design simplifies the mounting/disengaging of the inner portion 206 to/from the disposer body. Alternatively, the tongues of the inner portion 206 and the grooves of the housing 118 can be so configured that the tongues 218 are interference-fitted in the grooves 210 and retained in place without the help of the stationary grind ring 500.

It should be understood, that the housing 118 could have the tongues and the inner portion 206 of the dishwasher inlet have the grooves. In an aspect, the tongues 218 of the inner portion 206 of the dishwasher inlet 202 may be secured in the grooves 210 of the housing 118 by friction, securing features formed on the tongues 218 and in the grooves 210, such as detents, mechanical fasteners, adhesives, welding, or other conventional fastening methods. Alternatively, the inner portion 206 of the dishwasher inlet 202 can be joined to the housing 118 by spin welding or other conventional fastening methods without the use of the tongue-and-groove design.

With specific reference to FIG. 3, by using a separate slide-in component for the inner portion 206 of the dishwasher inlet 202, the molding of the anti-vibration mount 220 and the housing 118 of the body of disposer 200 can thus be performed without any portion of the dishwasher inlet 202 extending into housing 118 to obstruct the molding process. Therefore, the mold tooling for both the housing 118 of the body of disposer 200 and an overmold shutoff can be significantly simplified and the molding process of the anti-vibration mount 220 and the housing 118 of the body of disposer 200 facilitated. Because the molding tool can access the entire portion of the anti-vibration mount 220, as indicated by reference arrows 222, without being obstructed by the dishwasher inlet 202, the anti-vibration mount 220 can be molded to have a constant and symmetric annular geometry.

In the design of disposer components, different parts of the disposer have different demands placed upon them, such as abrasion, impact, chemical exposure. By using a separate slide-in component for the inner portion 206 of the dishwasher inlet 202, a variety of materials can be used for the inner portion 206 of dishwasher inlet 202 and components of disposer 200 adjacent inner portion 206 to tailor them for improved durability, sound performance, and cost. Using a separate slide-in component for the inner portion 206 of the dishwasher inlet 202 allows for the use of a material that is optimized for a specific purpose without compromising material choices for adjoining parts.

Using a separate slide-in component for the inner portion 206 of the dishwasher inlet 202 also facilitates disposer 200 passing certain agency tests included in ASSE 1008, and protects the plastic dishwasher inlet knock-out in a wall of housing 118 from damage.

Using a separate slide-in component for the inner portion 206 of the dishwasher inlet 202 allows for the use of a more durable and more expensive material without the need to mold the entire housing body of disposer 200, or the entire housings 118, 140 of disposer 200, from more expensive materials.

Using a separate slide-in component for the inner portion 206 of the dishwasher inlet 202 allows for the use of different dishwasher inlet designs for a given housing 118 of disposer 200 to accommodate different grind mechanisms. This lends itself to a cost effective approach to meeting customer needs.

While the food waste disposer 200 is shown in the figures as being generally similar to food waste disposer 100 of FIG. 1, the main difference being the dishwasher inlet having the removable inner portion 206, it should be understood that the dishwasher inlet having a removable inner portion 206 is useful in any food waste disposer having a housing with a dishwasher inlet, particularly those having an anti-vibration mount molded about an inlet of the housing.

What is claimed is:

1. A food waste disposer, comprising:

a food conveying section, a motor section and a central grinding section disposed between the food conveying section, the motor section including a motor coupled to a the motor section including a motor having a motor shaft coupled to a rotatable plate of a grinding mechanism in the grinding section;

the food conveying section including a housing having dishwasher inlet having an outer portion extending outwardly from the housing and an inner portion extending into the housing that is removably received in the housing, the inner and outer portion being separate pieces having passageways connected by an opening in the housing when the inner portion is in place in the housing; and an anti-vibration mount disposed around an inlet of the food conveying section wherein the anti-vibration mount is overmolded around the inlet of the food conveying section, and the housing and the outer portion of the dishwasher inlet are a molded plastic piece wherein the outer portion is an integral portion of the housing.

2. The apparatus of claim 1 wherein the housing includes a feature disposed adjacent the opening in the housing that engages a corresponding feature of the inner portion of the dishwasher inlet.

3. The apparatus of claim 2 wherein the feature of the housing includes the housing having tongues on opposite sides of the opening and the feature of the inner portion of the dishwasher inlet includes grooves on opposite sides of a body of the inner portion, the tongues slidably received in the grooves.

4. The apparatus of claim 3 wherein the grinding section includes a stationary grind ring that abuts the inner portion of the dishwasher inlet when the dishwasher inlet is received in the housing, the grind ring holding the inner portion of the dishwasher inlet in place.

5. The apparatus of claim 3 wherein the tongues are interference fitted in the grooves.

6. A food waste disposer, comprising:

a food conveying section, a motor section and a central grinding section disposed between the food conveying section, the motor section including a motor coupled to a the motor section including a motor having a motor shaft coupled to a rotatable plate of a grinding mechanism in the grinding section;

the food conveying section including a housing having dishwasher inlet having an outer portion extending outwardly from the housing and an inner portion extending into the housing that is removably received in the housing, the inner and outer portion having passageways connected by an opening in the housing when the inner portion is in place in the housing;

the housing including a feature disposed adjacent the opening in the housing that engages a corresponding feature of the inner portion of the dishwasher inlet; and the feature of the housing having grooves on opposite sides of the opening and the feature of the inner portion of the dishwasher inlet includes tongues on opposite sides of a body of the inner portion, the tongues slidably received in the grooves.

7. The apparatus of claim 6 wherein the grinding section includes a stationary grind ring that abuts the inner portion of the dishwasher inlet when the dishwasher inlet is received in the housing, the grind ring holding the inner portion of the dishwasher inlet in place.

8. The apparatus of claim 6 wherein the tongues are interference fitted in the grooves.

9. The apparatus of claim 6 including an anti-vibration mount overmolded around an inlet of the food conveying section.

10. The apparatus of claim 9 wherein the housing and the outer portion of the dishwasher inlet are a molded plastic piece wherein the outer portion is an integral portion of the housing.

* * * * *